US005942088A

United States Patent [19]

Shackford et al.

[11] Patent Number: 5,942,088

[45] Date of Patent: Aug. 24, 1999

[54] APPARATUS FOR BLEACHING HIGH CONSISTENCY PULP WITH A GASEOUS BLEACHING REAGENT

[75] Inventors: Lewis D. Shackford, Merrimack; L. Allan Carlsmith, Amherst, both of N.H.

[73] Assignee: Beloit Technologies, Inc., Wilimington, Del.

[21] Appl. No.: 08/939,357

[22] Filed: Sep. 29, 1997

Related U.S. Application Data

[62] Division of application No. 08/669,059, Jun. 24, 1996.
[60] Provisional application No. 60/001,446, Jul. 26, 1995.

[51] Int. Cl.[6] ..... D21C 7/06; D21C 7/12; D21C 9/153

[52] U.S. Cl. ..... 162/242; 162/243; 162/246

[58] Field of Search ..... 162/57, 19, 65, 162/243, 246, 234, 235, 236, 242; 8/156, 111; 241/28; 366/303, 304, 305, 307

[56] References Cited

U.S. PATENT DOCUMENTS

| | | |
|---|---|---|
| 1,827,710 | 10/1931 | Küchenmeister . |
| 2,627,668 | 2/1953 | Handwerk . |
| 2,722,163 | 11/1955 | Cumpston, Jr. . |
| 2,756,646 | 7/1956 | Jones . |
| 2,963,086 | 12/1960 | Green . |
| 3,145,936 | 8/1964 | Monks . |
| 3,243,129 | 3/1966 | Jones . |
| 3,293,117 | 12/1966 | Pennington, Jr. et al. . |
| 3,309,031 | 3/1967 | McMahon et al. . |
| 3,387,796 | 6/1968 | Cormack et al. . |
| 3,471,093 | 10/1969 | Weinert . |
| 3,579,717 | 5/1971 | Middlebrooks . |
| 3,630,828 | 12/1971 | Liebergett et al. . |
| 3,725,193 | 4/1973 | De Montigny et al. . |
| 3,785,577 | 1/1974 | Carlsmith et al. . |
| 3,814,664 | 6/1974 | Carlsmith . |
| 3,917,176 | 11/1975 | Carlsmith . |
| 3,964,962 | 6/1976 | Carlsmith . |
| 4,080,249 | 3/1978 | Kempf et al. . |

(List continued on next page.)

FOREIGN PATENT DOCUMENTS

| | | | |
|---|---|---|---|
| 80441/91 | 7/1991 | Australia . | |
| 869267 | 5/1968 | Canada . | |
| 2044898 | 6/1991 | Canada . | |
| 2044907 | 6/1991 | Canada . | |
| 2046717 | 7/1991 | Canada . | |
| 0 492 039 A1 | 6/1991 | European Pat. Off. . | |
| 0 492 040 A1 | 6/1991 | European Pat. Off. . | |
| 0 515 303 A1 | 5/1992 | European Pat. Off. . | |
| 2620744 A1 | 9/1987 | France . | |
| 2672314 | 11/1991 | France . | |
| WO 91/18145 | 5/1990 | WIPO . | |
| WO 92/07999 | 10/1991 | WIPO . | |
| WO 94/15018 | 12/1993 | WIPO . | |
| 94/15018 | 7/1994 | WIPO | 162/52 |
| WO 95/08667 | 9/1994 | WIPO . | |
| 95/08667 | 3/1995 | WIPO | 162/65 |

*Primary Examiner*—Steven Alvo
*Attorney, Agent, or Firm*—Hill & Simpson

[57] ABSTRACT

A method and apparatus for bleaching high consistency pulp with a gaseous bleaching reagent. The pulp is shredded and then fluffed in the presence of a contacting gas which includes the gaseous bleaching reagent within an upstream vessel comprising a pin/foil contactor so as to suspend the pulp in the contacting gas and react the bleaching reagent with the pulp. The pulp is retained in the contactor for a predetermined time which is sufficient to consume about 75% to about 90% of a selected dose of the gaseous bleaching reagent which is required to delignify the high consistency pulp from an initial Kappa number to an intermediate Kappa number. The pulp and contacting gas are then separately supplied to a porous bed reactor where the reaction of the selected dose of the gaseous bleaching reagent with the pulp is substantially completed so as to further delignify the high is consistency pulp from the intermediate Kappa number to a final Kappa number.

7 Claims, 4 Drawing Sheets

U.S. PATENT DOCUMENTS 4,096,027 6/1978 Sherman .
4,123,317 10/1978 Fritzvold et al. .
4,278,496 7/1981 Fritzvold .
4,279,694 7/1981 Fritzvold et al. .
4,283,251 8/1981 Singh .
4,298,426 11/1981 Torregrossa et al. .
4,303,470 12/1981 Meredith et al. .
4,426,256 1/1984 Johnsen .
4,468,286 8/1984 Johnsen .
4,581,104 4/1986 Luthi .
4,664,320 5/1987 Steffens .
4,729,516 3/1988 Williams, Jr. .
4,744,722 5/1988 Sämpi et al. .
5,087,326 2/1992 Jones .
5,174,861 12/1992 White et al. .
5,181,989 1/1993 White et al. .
5,188,708 2/1993 Griggs et al. .
5,198,075 3/1993 La Bruniere et al. .
5,277,371 1/1994 Bowns et al. .
5,364,038 11/1994 Prew .
5,409,570 4/1995 Griggs et al. .
5,451,296 9/1995 Pikulin et al. .
5,562,806 10/1996 Abdulmassih et al. .
5,626,297 5/1997 Carlsmith et al. .
5,630,909 5/1997 LaRiviere ..... 162/243

APPARATUS FOR BLEACHING HIGH CONSISTENCY PULP WITH A GASEOUS BLEACHING REAGENT

CROSS-REFERENCES

This is a divisional of application Ser. No. 08/669,059, filed Jun. 24, 1996.

The subject application is a continuation-in-part of U.S. Provisional Patent Application having Ser. No. 60/001,446 filed on Jul. 26, 1995, entitled: "Ozone Bleaching System Combining Pin Fluffer And Bed Reactor", and is related to the following and commonly assigned U.S. patent applications which are expressly incorporated by reference herein: Ser. No. 08/125,053 filed on Sep. 21, 1993, entitled "Apparatus For Fluffing High Consistency Wood Pulp"; Ser. No. 08/335,282 filed on Nov. 7, 1994, entitled "Apparatus For Fluffing And Contacting High Consistency Wood Pulp With a Gaseous Bleaching Reagent", now U.S. Pat. No. 5,630,909; and Ser. No. 08/398,317 filed on Mar. 3, 1995, entitled "Variable Angle Powered Cyclone", now U.S. Pat. No. 5,562,806.

BACKGROUND OF THE INVENTION

1. Field of the Invention

The present invention relates generally to the bleaching of lignocellulosic materials for use in the pulp and paper industry, and more particularly to a method and apparatus for bleaching high consistency pulp with a gaseous bleaching reagent such as ozone.

2. Related Art

The use of gaseous reagents, including chlorine dioxide and ozone, for the bleaching of lignocellulosic materials including wood pulp is well known in the art. It is further known, particularly with respect to the bleaching of high consistency wood pulp, that mechanical mixing of the pulp in the presence of the bleaching reagent is required to enhance the rate of reaction between the bleaching reagent and the pulp and to achieve uniformity of the resultant bleached pulp.

As known in the art, wood pulp is obtained from the digestion of wood chips or from repulping of recycled paper or from other sources and is commonly processed in pulp and paper mills in slurry form in water. As used herein, the term "consistency" is used to express the measured ratio of dry pulp fibers to water, or more specifically, the weight of dry pulp fibers in a given weight of pulp slurry or "pulp stock" as a percentage. Various definitions are used, such as air-dry consistency (a.d. %), or oven-dry consistency (o.d. %), or moisture-free consistency (m.f. %). The laboratory techniques for measuring these values can be found in references well known in the art, such as the TAPPI Standards Manual. Terms widely used to describe ranges of stock consistency useful in pulp and paper plants follow:

Low Consistency—below about 4–6% o.d.

Medium Consistency—about 9–18% o.d.

High Consistency—above about 18–20% o.d., but more commonly above about 25% o.d.

The primary characteristic of pulp slurries which changes with consistency is the fluidity. Low consistency slurries flow like water and can easily be pumped through pipelines using normal centrifugal pumps. In contrast, medium consistency pulp slurries have a paste-like character, do not flow by gravity, and can only be pumped in pipelines by using specially designed pumps. Also in contrast, wood pulp in the high consistency range does not have a slurry-like character, but is better described as a damp, fibrous, solid mass. Upon superficial examination, high consistency wood pulp appears to be and act like a dry solid. Accordingly, high consistency wood pulp generally cannot be pumped through any great distance in pipelines because the pipe wall friction is very high, resulting in uneconomic pumping horsepower requirements. However, this characteristic is used to advantage in some prior art bleaching systems which feed high consistency pulp to a gas filled vessel through a short length of pipe in which the pulp forms a plug sufficiently impermeable to prevent loss of reaction gas in the reverse direction. High consistency wood pulp has an additional characteristic which is that it can be fluffed, in the same way that dry fibrous solids such as cotton or feathers can be fluffed, to give a light and porous mass, the inner fibers of which are accessible to a chemical reagent in gaseous form. Fluffed, high consistency pulp can be blown with air or bleaching gases through pipelines provided sufficient velocity is used to prevent the wet fibers from settling out of the gas suspension. It is understood in the art that the agitation of pulp, for the aforementioned reasons, requires the expenditure of energy and increases the pulp processing costs both with regard to the initial capital investment and with regard to equipment maintenance costs in proportion to the degree of mechanical effort expended.

One known system for bleaching high consistency pulp with chlorine dioxide includes a device commonly referred to as a fluffer/blower. The pulp is mechanically fluffed within the fluffer/blower in the presence of the chlorine dioxide and the associated carrier gas so as to form a gas-suspended mixture for transport and initiation of the bleaching reaction. The gas-suspended pulp is then transported through a conduit to the top of a reactor tower, of the porous bed type. A relatively high transport velocity is required within the conduit and accordingly the flow within the conduit is turbulent in nature, which maintains the pulp in a gas-suspended mixture and continues the reaction of the pulp with the chlorine dioxide. The pulp then enters an upper portion, commonly referred to as a cyclone, of the porous-bed reactor tower in a tangential manner, causing the gas-suspended pulp to swirl around the inner wall of the reactor tower cyclone, so as to further react the pulp with the chlorine dioxide and at the same time to separate the pulp from an excess of gas required for transport, with the excess gas being returned to the fluffer/blower. The pulp then drops onto a porous bed of fluffed pulp, within the reactor tower, which continuously moves downward through the reactor tower toward an expanded section which acts as a gas separation chamber. The total residence time of the pulp within the fluffer/blower, the transport conduit and the reactor tower cyclone (prior to the pulp dropping onto the porous bed of fluffed pulp) is approximately 5 seconds. Notwithstanding the relatively short combined pulp residence time a substantial portion of the chlorine dioxide, comprising about 60% to about 80% of a given chlorine dioxide dose, is consumed within the fluffer/blower, transport conduit and reactor tower cyclone due to the very fast reaction rate characteristics of chlorine dioxide. The chlorine dioxide and carrier gas flow downward through the porous bed at a substantially higher velocity than that at which the pulp bed moves downward through the reactor, so as to substantially complete the reaction of the chlorine dioxide with the pulp. The carrier gas then flows into a gas separation chamber within the reactor and is subsequently recycled. Although bleaching systems of this type have proven somewhat effective for the bleaching of high consistency pulp with chlorine dioxide, they are subject to the following limitations. The pulp residence time within the fluffer/blower is substantially fixed and is controlled by the fluffer speed required to achieve shredding and fluffing of the pulp. The pulp residence time within the transport conduit interconnecting the fluffer/blower and the bed reactor is also substantially fixed (without an impractical increase in conduit length) due to the transport velocity required within the conduit. Accordingly, such systems provide limited flexibility with regard to the ability to vary pulp residence time, while the pulp is agitated and maintained suspended in the gaseous bleaching reagent.

Recently, there have been many efforts to utilize ozone as the bleaching reagent for high consistency wood pulp, and other lignocellulosic materials, to avoid the use of chlorine (and the attendant environmental problems) in such bleaching processes. Although ozone may initially appear to be an ideal material for bleaching lignocellulosic materials, the exceptional oxidative properties of ozone and its relatively high cost have limited the development of satisfactory devices and processes for ozone bleaching of lignocellulosic materials. For instance, the inventors have determined that the previously described system for bleaching high consistency wood pulp with chlorine dioxide does not provide optimum results when bleaching with ozone, due to the aforementioned inflexibility regarding pulp residence time with the pulp in an agitated, gas-suspended state. Also, a large amount of energy is required, in addition to that expended in fluffing the pulp, to transport the gas suspension of pulp from the fluffer/blower to the top of the bed reactor.

The foregoing illustrates limitations known to exist in present wood pulp bleaching operations. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a method for bleaching high consistency pulp with a gaseous bleaching reagent comprising the steps of:

- supplying a high consistency pulp to a first, upstream vessel;
- shredding the pulp within the upstream vessel in the presence of a contacting gas including the gaseous bleaching reagent, a carrier gas, and reaction by-product gases so as to suspend the pulp in the contacting gas and to initiate reaction of the gaseous bleaching reagent with the pulp;
- fluffing the shredded pulp within the upstream vessel in the presence of the contacting gas so as to maintain the pulp in suspension in the contacting gas and to further react the gaseous bleaching reagent with the pulp, wherein said step of fluffing includes the steps of
  - creating a rotating annulus of fluidized particles of the shredded pulp within the upstream vessel,
  - combing the rotating annulus of fluidized particles of the shredded pulp so as to further reduce the size of the shredded pulp particles and to fluff the pulp particles;
- retaining the high consistency pulp within the upstream vessel for a predetermined time which is sufficient to consume about 75% to about 90% of a selected dose of the gaseous bleaching reagent which is required to delignify the high consistency pulp from an initial Kappa number to an intermediate Kappa number; and
- discharging the fluffed pulp and the contacting gas from the upstream vessel to a second, downstream vessel in which the reaction of the selected dose of the gaseous bleaching reagent with the pulp is substantially completed so as to further deliginify the high consistency pulp from the intermediate Kappa number to a final Kappa number.

According to a second aspect of the present invention, this is accomplished by providing a system for bleaching high consistency pulp with a gaseous bleaching reagent, with the system comprising:

- a substantially vertical pin/foil contactor having a gas inlet, a gas outlet, a pulp inlet, and a pulp outlet;
- means for supplying high consistency pulp to said pulp inlet of said contactor;
- means for supplying fresh bleaching gas to said gas inlet of said contactor; and
- a porous bed reactor having a gas inlet, a gas outlet, a pulp inlet, and a pulp outlet, wherein said gas inlet of said reactor is in fluid communication with said gas outlet of said contactor and wherein said pulp inlet of said reactor communicates with said pulp outlet of said contactor; and
- wherein said contactor further includes means for shredding the high consistency pulp supplied to said pulp inlet of said contactor and means for fluffing the shredded pulp.

BRIEF DESCRIPTION OF THE DRAWINGS

The foregoing and other aspects of the present invention will become more apparent from the subsequent Detailed Description of the invention when considered in conjunction with the accompanying drawing figures, wherein.

DETAILED DESCRIPTION

Figure 1:
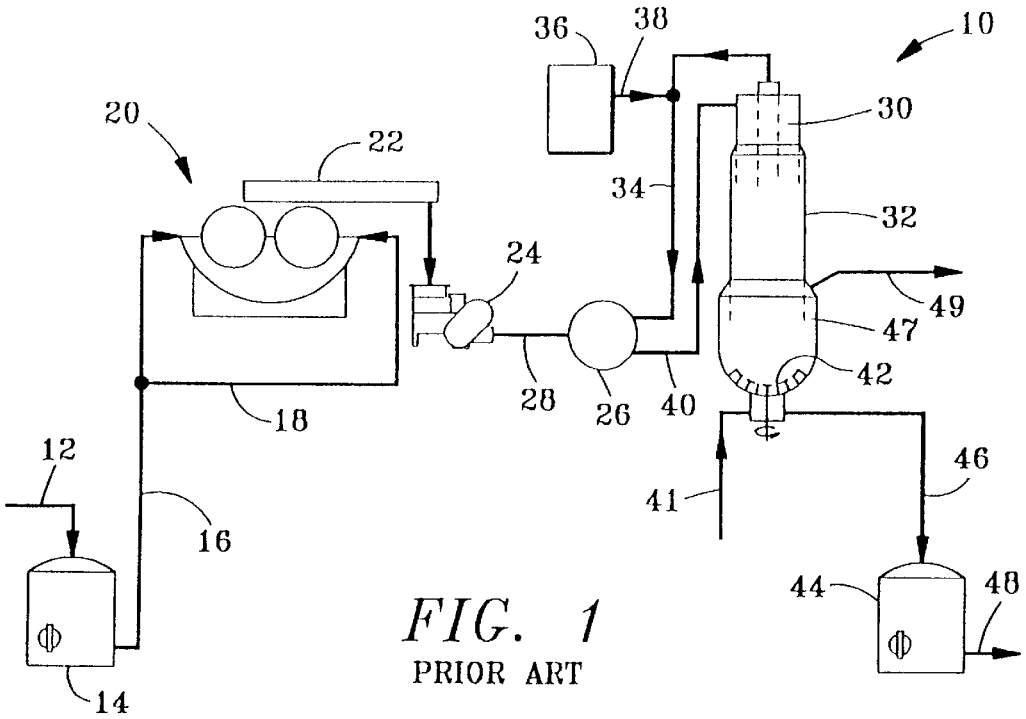
FIG. 1 PRIOR ART
FIG. 1 schematically illustrates a prior system for bleaching lignocellulosic materials, such as high consistency wood pulp, with a gaseous bleaching reagent.

Referring now to the drawings, FIG. 1 schematically illustrates a prior art system 10 for bleaching lignocellulosic materials, such as high consistency wood pulp, with a gaseous bleaching reagent comprising chlorine dioxide. Wood pulp 12 enters a press feed tank 14 where it is diluted with pressate to form a pulp slurry having a consistency of about 4%. Sulfuric acid is added to the pulp slurry within tank 14 so as to reduce the pH of the pulp slurry to about 2–3. The pulp slurry is then transported, via conduits 16 and 18, to a twin roll dewatering press, such as an IMPCO Vari-Nip® twin roll press made by the Beloit Corporation. The pulp is then shredded in a double flight conveyor 22 and transported externally of press 20 where it drops into a thick stock pump 24 such as an IMPCO Clove-Rotor® thick stock pump made by the Beloit Corporation. The high consistency pulp discharging from pump 24 is supplied to a fluffer/blower 26 via conduit 28. The fluffer/blower 26 includes means for disintegrating, or shredding the high consistency pulp into relatively small flocs and also fluffs the pulp in the presence of a bleaching gas including a gaseous bleaching reagent, comprising chlorine dioxide, and a carrier gas, so as to suspend the fluffed pulp in the bleaching gas. A flow of bleaching gas is supplied to the fluffer/blower 26 from an upper portion 30 of a substantially vertically oriented porous bed reactor 32 via conduit 34. Fresh bleaching gas is supplied to conduit 34 from a source 36 of chlorine dioxide via conduit 38. The reaction of the chlorine dioxide with the high consistency pulp is initiated in the fluffer/blower 26 and continues in the conduit 40, used to transport the gas-suspended pulp to reactor 32, and in the upper portion 30 of the reactor 32. The flow through conduit 40 is turbulent in nature which agitates the pulp and maintains the pulp in a gas-suspended mixture with the chlorine dioxide and the associated carrier gas. The gas-suspended pulp enters the upper portion 30 of reactor 32 from conduit 40 in a tangential manner so that the gas-suspended pulp swirls around the inner wall of the upper portion 30 of reactor 32 in a cyclonic fashion. Hence, portion 30 may be referred to in the art as a cyclone. The pulp then drops onto a porous bed of fluffed pulp (not shown) within reactor 32, and the pulp bed moves continuously downward through reactor 32. Since the flow of gas required for pulp transport through conduit 40 is usually much larger than the fresh bleaching gas entering from conduit 38, the excess gas is separated from the pulp in cyclone 30 and returned to the fluffer/blower 26 through conduit 34. The inventors have determined that the combined pulp residence time within the fluffer/blower 26, conduit 40 and the upper portion 30 of reactor 32 (prior to the pulp falling on the fluffed bed) is approximately 5 seconds. Due to the agitation of the pulp, and consequently the intimate contact of the pulp with the chlorine dioxide, within the fluffer/blower 26, conduit 40 and the upper portion 30 of reactor 32, about 60% to about 80% of a given dose of the chlorine dioxide is consumed within fluffer/blower 26, conduit 40 and the upper portion 30 of reactor 32. This relatively large percentage of chlorine dioxide is consumed, notwithstanding the relatively short pulp residence time, since the reaction rate of chlorine dioxide with pulp is very fast. Substantially all of the remaining chlorine dioxide is consumed as the chlorine dioxide passes through the fluffed pulp bed, at a substantially higher velocity than that at which the bed moves downward through reactor 32. The fluffed bed of pulp may reside in reactor 32 for a relatively long time, on the order of several minutes, to substantially complete the reaction of the chlorine dioxide with the pulp due to the characteristic "tail" of the chlorine dioxide bleaching kinetics curve, which is known in the art. A dilution liquor, indicated by flow arrow 41, may be added to a lower portion of reactor 32 so as to achieve a desired consistency of the pulp for further processing. The manner in which the pulp discharges from reactor 32 depends on the requirements of the subsequent bleaching stage of the associated processing plant. In the system 10 shown in FIG. 1, the pulp is extracted from reactor 32 using a dilution scraper 42, with the diluted pulp then being transferred to a receiving tank 44 via conduit 46. The pulp may then discharge tank 44, after appropriate treatment, for further processing as shown by flow arrow 48. Any remaining chlorine dioxide which has not been consumed, as well as the associated carrier gas, discharges into an annular gas separation chamber 47 of reactor 32 and discharges from chamber 47 for further processing, as shown by flow arrow 49.

Although system 10 has been used with success in certain applications, such as the aforementioned bleaching of high consistency pulp with chlorine dioxide, it is subject to the following limitations. The pulp residence time within the fluffer/blower 26 is substantially fixed and is controlled by the rotational speed which is required to achieve disintegration and fluffing of the high consistency pulp supplied to fluffer/blower 26. The pulp residence time within transport conduit 40 is also substantially fixed (without an impractical increase in conduit length) due to the relatively high transport velocity required within conduit 40. Accordingly, system 10 provides very limited flexibility with regard to changing the pulp residence time prior to contacting the fluffed bed of pulp within reactor 32.

Figure 2:
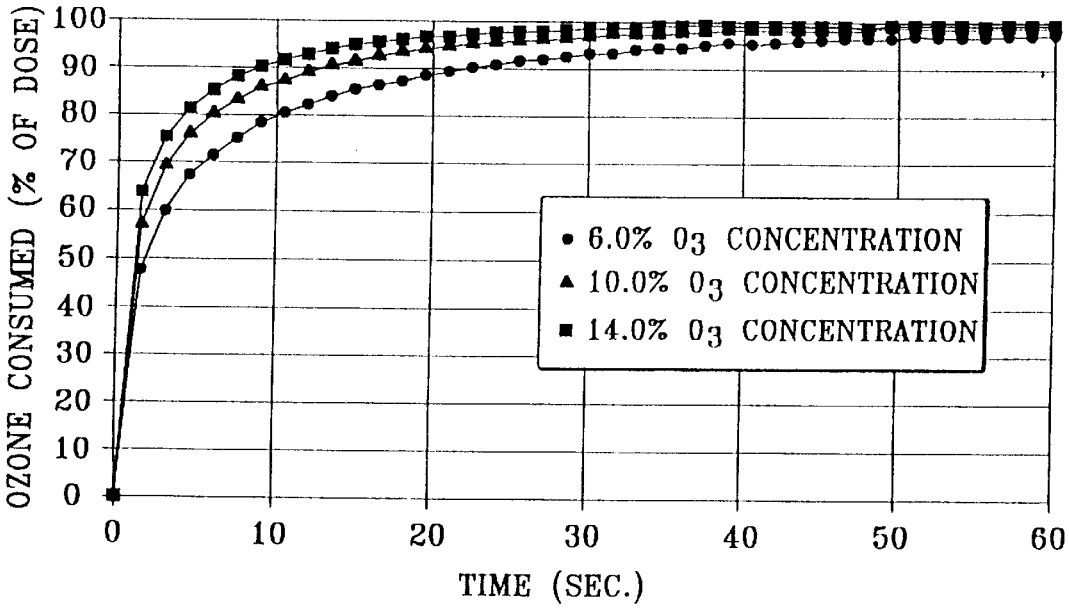
FIG. 2 graphically illustrates the kinetics of the reaction of ozone with high consistency high consistency wood pulp, for various ozone in carrier gas concentrations in a continuous co-current plug flow reactor.

The inventors have experimentally determined the bleaching kinetics of ozone, or the rate of reaction of ozone with high consistency pulp, which is shown in FIG. 2 for a variety of concentrations of ozone in an oxygen carrier gas ranging from 6% ozone concentration to 14% ozone concentration. This range of ozone concentrations represents those which are presently commercially available and economically feasible in the required quantities for the commercial bleaching of high consistency wood pulp, with 6% ozone concentration presently being particularly attractive from a cost standpoint. However, it is noted that ozone generator technology is rapidly changing and that accordingly, other concentrations of ozone may become economically viable in the future. The data presented in FIG. 2 was experimentally determined as follows. A laboratory scale batch apparatus was built to measure ozone consumption in a mechanically agitated bleaching contactor at residence times as short as 2 seconds. Ozone delignifications were run at various gas concentrations and residence times using a Canadian softwood Kraft pulp which had been oxygen delignified in the laboratory to 10.5 Kappa number. The contactor included a 5 liter capacity reaction chamber, suitable for accepting a charge of approximately 100 g o.d. fluffed pulp. The Kraft-oxygen pulp samples were well washed, acidified to pH 2 with sulfuric acid at low consistency and then dewatered in a press to 40% o.d. Portions of the pulp cake were weighed out and then fluffed immediately prior to each run in the contactor. The dewatered, fluffed pulp was manually charged into the reaction chamber which was then closed. Air was evacuated with a vacuum pump and a high speed (1750 rpm) rotor fitted with pointed pins and rotatably mounted within the reaction chamber, was started. Next, a quick opening valve allowed the ozone/oxygen gas to rush in from an accumulator. This was followed by a reaction period at constant pressure and the rotor kept the fluffed pulp rotating in a layer against the inner wall of the reaction chamber and imparted a combing action to the fiber flocs. Next, a fast nitrogen purge expelled residual gas to a second accumulator for titration. The combined inrush and reaction period was varied from about 2 seconds to about 60 seconds in successive runs. The ozone gas charge was calculated from the initial and final pressures and the known volume of the reaction chamber, and its concentration by titrating a volumetric sample from the feed accumulator. The total residual ozone was obtained from titration of samples from the purged gas accumulator. The consumed ozone was the difference of these two calculations.

The inventors have determined that for optimum bleaching results using ozone, that it is desirable to consume about 75% to about 90%, and more preferably about 80% to about 90%, of the ozone dose while the high consistency pulp is being agitated and suspended within the ozone, which contrasts with the 60% to 80% of chlorine dioxide consumed in system 10 during the period of time that the pulp is suspended in the chlorine dioxide within fluffer/blower 26, transport conduit 40 and the cyclone, or upper portion 30 of the porous bed reactor 32. As shown in FIG. 2, the time required to achieve the more preferred range of about 80% to about 90% ozone consumption, for a given ozone dose, varies from about 5 seconds to about 20 seconds, depending upon the concentration of the ozone used. Also as shown in FIG. 2, if the concentration of the ozone is 6%, which is presently economically attractive, the time required to achieve 80% to 90% ozone consumption varies from about 10 seconds to about 20 seconds. Accordingly, based on the combined pulp residence time of about 5 seconds within fluffer/blower 26, transport conduit 40 and the cyclone 30 of reactor 32, in combination with the aforementioned limited flexibility of system 10 to vary the pulp residence time within the fluffer/blower 26 and transport conduit 40, the inventors have determined that system 10 is not adequate for producing optimum results when bleaching high consistency wood pulp with ozone.

Figure 3:
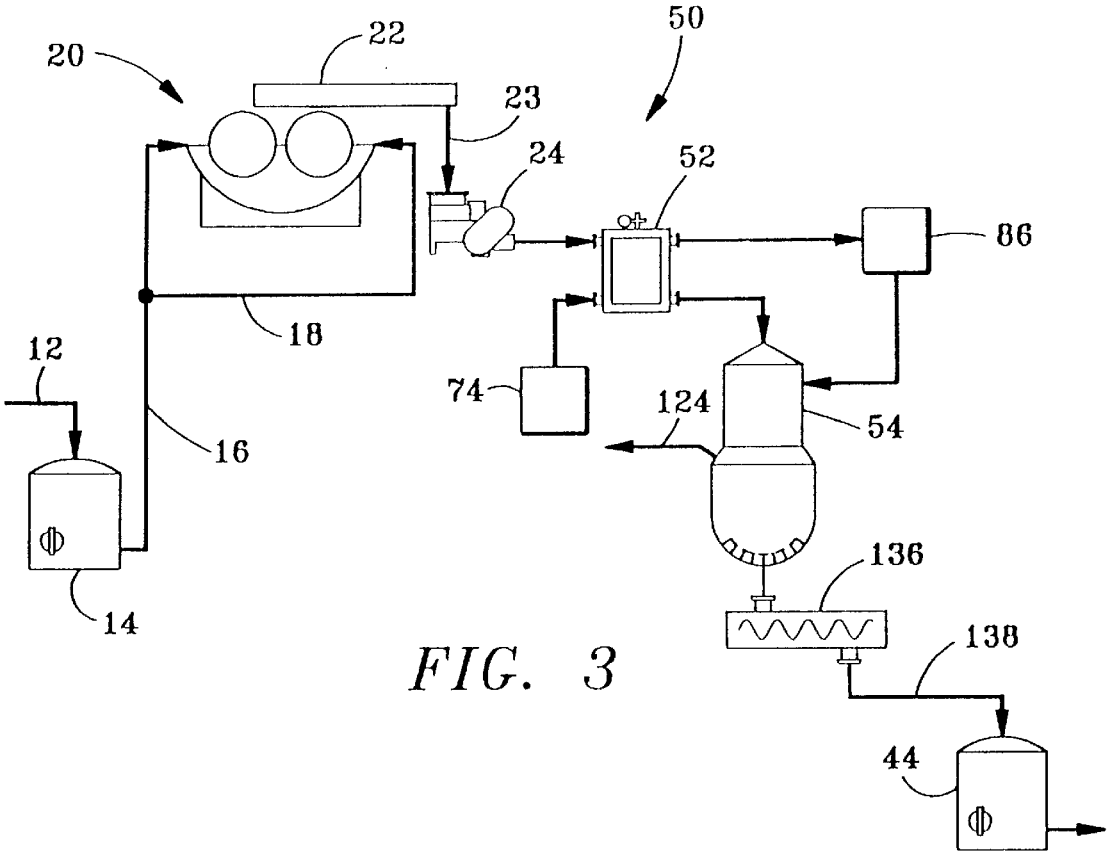
FIG. 3 schematically illustrates a system for bleaching lignocellulosic materials, such as high consistency wood pulp, with a gaseous bleaching reagent, according to the present invention.
Figure 5:
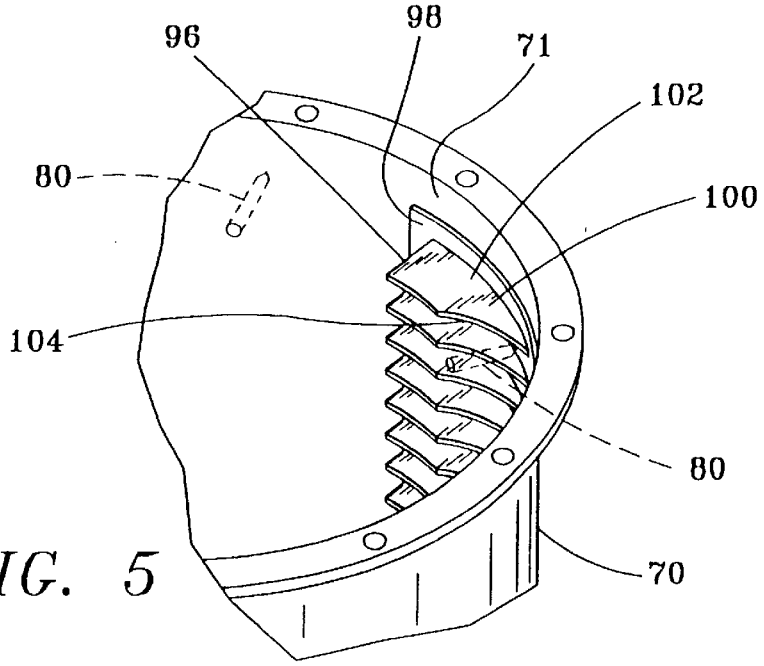
FIG. 5 is a partial, perspective view further illustrating a portion of the pulp bleaching system shown in FIG. 4.
Figure 4:
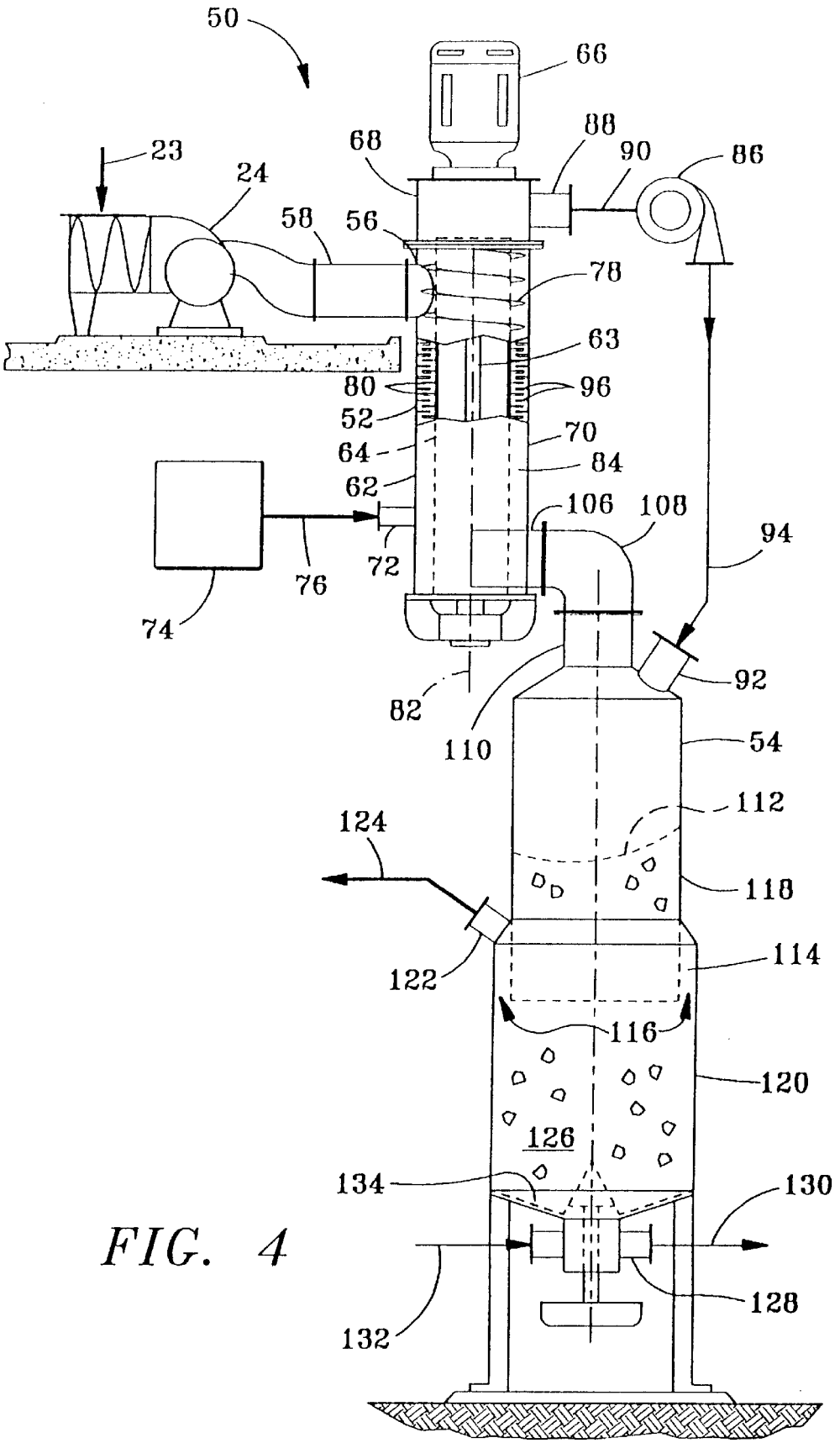
FIG. 4 is an elevational view, partly in cutaway view, further illustrating a portion of the pulp bleaching system shown in FIG. 3.

Referring now to FIGS. 3, 4, and 5 a system 50 for bleaching lignocellulosic materials, such as high consistency wood pulp, with a gaseous bleaching reagent, is illustrated according to a preferred embodiment of the present invention. System 50 is shown in schematic form in FIG. 3, and specific details of construction of portions of system 50 are further illustrated in FIGS. 4 and 5. As described herein, the apparatus of the present invention depicted in the illustrative embodiment shown in FIGS. 3–5, will be described in conjunction with a method for bleaching high consistency wood pulp utilizing ozone as the gaseous bleaching reagent, according to the method of the present invention. The apparatus and method of the present invention are not intended to be utilized for the bleaching of either medium consistency or low consistency wood pulp. As known in the art, due to the manner in which ozone is generated, ozone is typically available at a relatively low concentration within a carrier gas, such as oxygen or air. Typically, the concentration of ozone which is presently commercially available at attractive costs, ranges from about 6% to about 10% by weight when using oxygen as the carrier gas. As used herein, the term "contacting gas" will refer to the mixture of ozone in an oxygen carrier gas, as well as other gases and vapors, such as by-product gases of reaction, which are present at equilibrium conditions. The term "fresh bleaching gas" will be used to denote a mixture of ozone in an oxygen carrier gas supplied from a conventional source, such as a dryer/cleaner and ozone generator, which has not been reacted with the pulp and accordingly does not include reaction by-product gases.

The operation of system 50 is the same as that of system 10 up to the point where the high consistency pulp discharges from the Clove-Rotor® pump 24. As seen by comparing FIGS. 1 and 3, system 50 does not include the fluffer/blower 26, or the transport conduits 34 and 40 of system 10. Instead, after the high consistency pulp is discharged from the pump 24 in system 50, the high consistency pulp is bleached with ozone within a first, upstream vessel 52 and is then bleached within a second, downstream vessel 54, as subsequently described.

Referring again to FIGS. 3–5, a high consistency wood pulp 23 is supplied from the dewatering press 20 to the Clove-Rotor® pump 24 which operates in a manner well known in the art. Pump 24 forces the high consistency pulp 23 through a pipe 58 and into a pulp inlet 56 of vessel 52. Due to the frictional resistance of the pulp 23 within pipe 58, an impervious moving pulp plug is formed within conduit 58 which is effective for preventing the back-flow of contacting gas from vessel 52.

Vessel 52 comprises a pin/foil contactor and is substantially vertically oriented as shown in FIG. 4. Contactor 52 includes a housing 62 and a shaft 63 which is rotatably mounted within housing 62. Shaft 63 is rotatably driven by a motor 66 which may comprise a variable-speed motor. A rotor drum 64 is attached to shaft 63 for rotation with shaft 63. The housing 62 includes an upper portion 68, comprising a gas separation chamber, and a lower portion 70 with means contained therein for shredding the high consistency pulp supplied through pulp inlet 56 and for fluffing the pulp within the presence of a contacting gas including ozone, an oxygen carrier gas and by-product of reaction gases. Fresh bleaching gas, comprising ozone in an oxygen carrier gas, is supplied to a gas inlet 72 of contactor 52 from a source 74 of fresh bleaching gas via a conduit 76. The source 74 of fresh bleaching gas may comprise an ozone generator and a dryer/cleaner. A helically disposed screw flight 78 is attached to drum 64 for rotation therewith and is disposed below the gas separation chamber 68 and extends through an upper portion of the lower portion 70 of housing 62. The screw flight 78 is substantially aligned with the pulp inlet 56 of contactor 52, and includes a plurality of teeth-like surfaces disposed along the outer periphery of screw flight 78. Accordingly, screw flight 78 is effective for shredding the high consistency pulp entering through inlet 56 into relatively small particles. Screw flight 78 is also effective for imparting a circumferential velocity to the pulp particles within housing 62. Contactor 52 further includes a plurality of pins 80 which are attached to drum 64 and extend radially outwardly from drum 64 to a location proximate an inner wall 71 (shown in FIG. 5) of the lower portion 70 of housing 62. The pins rotate with shaft 63 and drum 64 about an axially extending, substantially vertical centerline axis 82 of contactor 52. Pins 80 are disposed in a plurality of axially spaced rows, with each axial row including a plurality of circumferentially spaced pins 80. The rotating action of the screw flight, or shredder 78 as well as the centrifugal force exerted on the shredded pulp by the rotating action of pins 80, forces the pulp radially outward against the inner wall 71 of the lower portion 70 of housing 62. A rotating annulus of fluidized particles of the shredded pulp is created in an annular space 84 which exists between the inner wall 71 of lower portion 70 of housing 62 and the rotor drum 64. The rotating annulus of pulp is rotatable about the centerline axis 82 of contactor 52, and has a tangential velocity which is less than that of the tips of pins 80. As shaft 63 and drum 64 are rotated, the tips of pins 80 comb through the annulus of pulp, so as to further reduce the size of the shredded pulp particles and to fluff the pulp particles in the presence of the contacting gas within housing 62. Accordingly, the fluffed pulp is maintained in a fluidized state within the contacting gas as it swirls around the inner wall of the lower portion 70 of housing 62 and moves downward through annulus 84. The ozone and oxygen carrier gas which enters housing 62 through gas inlet 72, flows upward through housing 62 in a countercurrent relationship with the pulp, which is moving downward through housing 62. The countercurrent flow of the contacting gas within housing 62 is induced by a blower 86 which is in fluid communication with a gas outlet 88 of contactor 52 via conduit 90. The gas outlet 88 is in fluid communication with the gas separation chamber 68 of contactor 52. The contacting gas discharging from contactor 52 to blower 86 is then supplied to a gas inlet 92 of the downstream vessel 54 via conduit 94.

The substantially vertical pin/foil contactor 52 further includes a plurality of circumferentially spaced columns of guide foils 96, with one of the columns being partially shown in perspective view in FIG. 5. The number of columns of guide foils 96 may vary with application. Each column of guide foils 96 includes a plurality of axially aligned and axially spaced guide foils 96, as shown in FIG. 5. The presence of guide foils 96 permits the substantially vertical pin/foil contactor 52 to be cylindrical in design, rather than conical, for instance. More specifically, guide foils 96 allow the desired pulp residence time within contactor 52 to be achieved. Without guide foils 96, the pulp would precipitously fall through contactor 52 in a very short period of time, preventing the desired bleaching of the pulp within contactor 52. The guide foils 96 of each column may be attached to a mount plate 98, which in turn is attached to the inner wall 71 of the lower portion 70 of housing 62. Each guide foil 96 includes a first, substantially flat portion 100 and a second, arcuate portion 102 which is curved upward relative to the flat portion 100 and functions in a manner similar to that of an airfoil by imparting lift to the fluffed pulp as it slides past each guide foil 96. As shown in FIG. 4, guide foils 96 are interleaved with pins 80 so that pins 80 and guide foils 96 are disposed in a vertically alternating arrangement. The vertically alternating arrangement of pins 80 and foils 96 extend substantially throughout the axial length of the lower portion 70 of housing 62. Each guide foil 96 further includes a leading edge 104, formed on the substantially flat portion 100. The leading edge 104 forms a shallow, radially inwardly diverging angle relative to a radial line, which serves to retard the development of pulp plugs and to promote the shedding of fiber build-up that would otherwise develop on a square leading edge. Additionally, the geometry of foils 96 is such that foils 96 exert a minimal drag on the rotating annulus of fluidized pulp particles so as not to retard the circumferential velocity of the rotating annulus of fluidized pulp particles. Furthermore, the projected frontal area of foils 96 is significantly smaller than that of pins 80 which is important as this relative sizing of foils 96 and pins 80 permits the formation of the rotating annulus of fluidized pulp particles. In a preferred embodiment, the projected frontal area of foils 96 is about one-fourth, or less, than the projected frontal area of pins 80. The projected frontal area of foils 96 is minimized consistent with the structural requirements of foils 96 and with the extent of the arcuate portion 102 of each foil 96 which is required to impart the desired lift to the fluffed pulp as it slides past each guide foil 96. Foils 96 are discussed and further illustrated (as element 25) in co-pending and commonly assigned U.S. patent application having Ser. No. 08/335,282.

As discussed previously, the inventors have determined that for purposes of enhanced uniformity of the bleached pulp, it is desirable to consume about 75% to about 90%, and more preferably about 80% to about 90%, of a given ozone dose while the pulp is in an agitated, gas-suspended mixture, such as that which exists within contactor 52. Accordingly, the pulp is retained within contactor 52 for a predetermined time which varies depending upon the desired percentage of ozone consumption and the ozone concentration. For instance, in order to achieve the more preferred range of about 80% to about 90% of ozone consumption within contactor 52, the pulp residence time within contactor 52 ranges from about 5 seconds to about 20 seconds for ozone concentrations ranging from 6% to 14%, due to the ozone bleaching kinetics shown in FIG. 2 which were experimentally determined by the inventors. This pulp residence time within contactor 52 may be achieved by varying the speed of motor 66, and the corresponding rotating speed of pins 80, as well as varying the flow rate of the bleaching gas supplied to inlet 72 of contactor 52 and the design of guide foils 96. The inventors have determined that the use of the substantially vertical pin/foil contactor 52 provides excellent results, with respect to uniformity of pulp bleaching, for the following reason. The intense agitation of the pulp with pins 80 causes the pulp to be maintained in suspension in the contacting gas in the form of a fluidized solid disposed in the annular space 84 between the rotor drum 64 and the inner wall 71 of the lower portion 70 of housing 62. Accordingly, all of the pulp is in intimate contact with the ozone bleaching reagent throughout the entire pulp residence time within contactor 52.

The pulp particles are discharged from contactor 52 through a tangentially oriented pulp outlet 106 of contactor 52. The circumferential velocity imparted to the pulp as it travels downward through housing 62 causes the pulp particles to be flung tangentially through outlet 106 into an elbow-shaped conduit, or pipe 108 which is attached at one end to a substantially vertically oriented pulp inlet 110 of the downstream vessel 54, which comprises a porous bed reactor. Virtually no contacting gas discharges from outlet 106 of contactor 52. Instead, as discussed previously, the contacting gas is separated from the pulp within gas separation chamber 68 and is then routed to the gas inlet 92 of the porous bed reactor 54 via conduits 90 and 94 and blower 86. The fluffed pulp entering reactor 52 through inlet 110 drops onto a porous bed 112 of fluffed pulp, which moves continuously downward through the porous bed reactor 54. The contacting gas flows through the porous bed at a substantially higher velocity than that of the bed, so as to substantially complete the reaction of the pulp with the ozone. The pulp residence time within reactor 54 may be varied, by varying the fill level of the pulp within reactor 54, for instance, so that about 95% to about 97% of a given ozone dose is consumed after the contacting gas has passed through the porous bed. The oxygen carrier gas, and any remaining ozone which has not been consumed, then discharges into an annular gas separation chamber 114, as indicated by flow arrows 116. The gas separation chamber 114 is formed at the interface between the relatively smaller diameter, generally cylindrical upper portion 118 of reactor 54 and the relatively larger diameter, generally cylindrical lower portion 120 of reactor 54. The gas entering the gas separation chamber 114 then discharges reactor 54 through a gas outlet 122, as shown by flow arrow 124, with the gas being recycled for further processing. For instance, the gas discharging from outlet 122 may be supplied to a dryer/cleaner and ozone generator so that the oxygen carrier gas may be reused. The bleached pulp 126 at the bottom of reactor 54 then discharges reactor 54 through a pulp outlet 128 as shown by flow arrow 130, for further processing. The selection of the apparatus used to discharge the pulp from reactor 54 depends on the requirements of the following bleaching system. If the pulp will be washed prior to the next bleach stage, the pulp is diluted with pressate, indicated by flow arrow 132 in FIG. 4, to about 6% consistency, and is then discharged from reactor 54 to a mix tank (not shown in FIG. 4) using a dilution scraper 134 mounted within a lower portion of reactor 54. On the other hand, if the pulp will be subsequently processed in a medium consistency bleach tower, it may be extracted to a twin screw discharger device, such as the screw-type conveyor 136 shown in FIG. 3, transported to a tank 44 via a conduit, or pipe 138, and then diluted within tank 44 to about 12% consistency for subsequent supply to a thick stock pump (not shown) downstream of tank 44.

Figure 6:
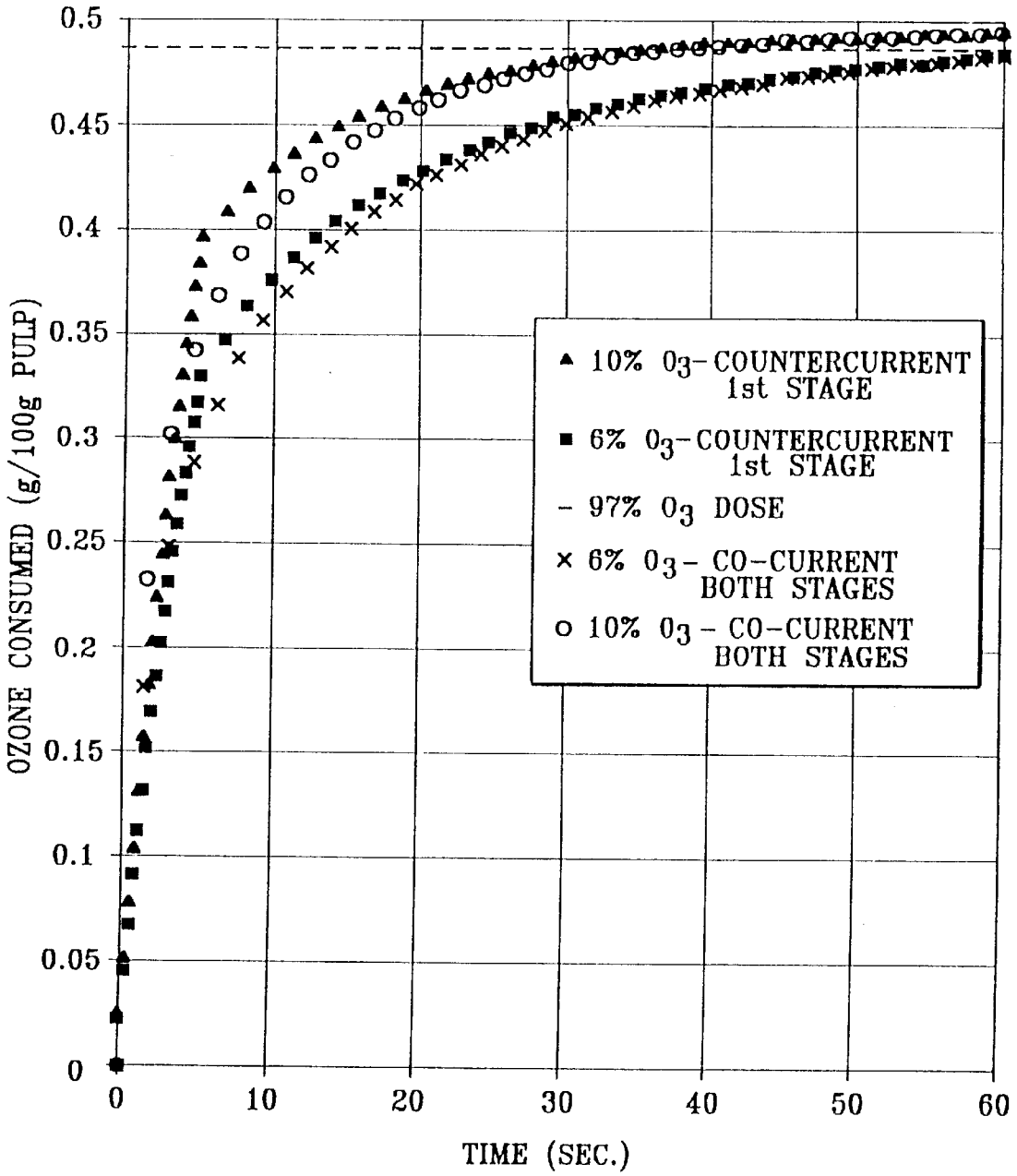
FIG. 6 illustrates the ozone bleaching kinetics within the apparatus of the present invention and compares the effects of co-current and counter-current flow of ozone in an upstream, or first stage bleaching vessel, followed by co-current flow of ozone in a downstream, or second stage bleaching vessel.

FIG. 6 presents a comparison of ozone consumption as a function of pulp residence time for a two-stage ozone bleaching system such as that which is achieved within contactor 52 and reactor 54. The graphs indicated by solid squares and solid triangles correspond, respectively, to ozone concentrations of 6% and 10%, for a system having countercurrent flow of the ozone relative to the pulp in the first stage and co-current flow of the ozone relative to the pulp in the second stage, such as that discussed previously with respect to contactor 52 and reactor 54. The graphs shown with the letter X and open circles correspond, respectively, to ozone concentrations of 6% and 10% for a system having co-current flow of the ozone through both stages of bleaching. As shown in FIG. 6, for each ozone concentration, the system employing countercurrent flow of ozone in the first stage of bleaching results in greater ozone consumption, for a given pulp residence time, than the system having full co-current flow of the ozone relative to the pulp. The graphs shown in FIG. 6 were developed by the inventors by utilizing the experimentally determined ozone kinetics shown previously in FIG. 2, in conjunction with associated empirically determined bleaching rate constants and a computer simulation which permitted extrapolation of the data obtained with a single batch contactor, to a system having two continuous reactors. Each of the graphs shown in FIG. 6 corresponds to a Kraft softwood pulp which had been oxygen delignified in the laboratory to an initial Kappa No. of 10.3 and had a final Kappa No. of 3.8 after 97% of the ozone dose (which is shown in dashed lines in FIG. 6) was consumed. The ozone dose was equal to 0.5 g/100 g o.d. pulp. Intermediate Kappa Nos. of 4.8 and 4.2 were realized after 80% and 90%, respectively, of the ozone dose was consumed. The inventors have also determined that for a Kraft softwood pulp which had been partially delignified with oxygen to an initial Kappa No. of 18, the application of an ozone dose of 0.9 g/100 g. o.d. pulp resulted in a final Kappa No. of 4.0, after 97% of the ozone dose was consumed, in a simulated system having countercurrent flow of the ozone relative to the pulp in the first stage and co-current flow of the ozone relative to the pulp in the second stage, such as that discussed previously with respect to contactor 52 and reactor 54. In this case, intermediate Kappa Nos. of 6.8 and 5.5 were achieved after consumption of 80% and 90%, respectively, of the ozone dose.

In operation, the pulp residence time within pin/foil contactor 52 is controlled so that about 80% to about 90% of a given ozone dose is consumed within contactor 52 while the pulp is in an agitated, gas-suspended mixture, which results in uniformly bleached pulp. The residence time required to achieve this ozone consumption ranges from about 5 seconds to about 20 seconds within contactor 52, depending on the concentration of ozone used. Accordingly, contactor 52 accomplishes an even greater retention time than that existing in the fluffer/blower 26, conduit 40 and cyclone 30 of the prior chlorine dioxide system shown in FIG. 1. Additionally, the pulp shredding and fluffing accomplished in the prior fluffer/blower 26 of FIG. 1, as well as the agitation of the pulp within conduit 40 and cyclone 30, is accomplished in a single device of the present invention, corresponding to contactor 52. After discharging from contactor 52, the ozone/pulp reaction is substantially completed within porous bed reactor 54. The pulp bleaching system 50 of the present invention provides improved uniformity of pulp bleaching, in an economical manner, as compared to prior systems.

While the foregoing description has set forth a preferred embodiment of the invention in particular detail, it must be understood that numerous modifications, substitutions and changes can be undertaken without departing from the true spirit and scope of the present invention as defined by the ensuing claims. For instance, although a cylindrical construction is preferred for the housing 62 of the substantially vertical pin/foil contactor 52, the contactor housing may alternatively comprise a varying tapered conical housing, as shown in co-pending and commonly assigned U.S. patent application having Ser. No. 08/398,317, provided that a rotor is provided with a complimentary shape and the contactor remains substantially vertically disposed, as shown in U.S. patent application Ser. No. 08/398,317. Additionally, although the apparatus and method of the present invention have been illustrated using ozone as the gaseous bleaching reagent, the apparatus and method of the present invention may be advantageously utilized in conjunction with gaseous bleaching reagents other than ozone, such as chlorine monoxide, chlorine dioxide, and others. However, it should be understood that the previously discussed pulp residence times of system 50 are intended to apply to the bleaching of high consistency wood pulp with ozone. The invention is therefore not limited to specific preferred embodiments as described, but is only limited as defined by the following claims.

What is claimed is:

1. A system for bleaching high consistency pulp with a gaseous bleaching reagent, said system comprising:

a substantially vertical pin-foil contactor having a gas inlet disposed at a lower end thereof, a gas outlet disposed at an upper end thereof, a pulp inlet disposed at an upper end thereof, and a pulp outlet disposed tangentially at a lower end thereof;

means for supplying high consistency pulp to said pulp inlet of said contactor;

means for supplying fresh bleaching gas to said gas inlet of said contactor for counter-current flow through said contactor with respect to the pulp; and a substantially vertical porous bed reactor having a gas inlet disposed at an upper end thereof, a gas outlet, a pulp inlet disposed at said upper end thereof, and a pulp outlet, wherein a separate conduit comprising a blower connects said gas inlet of said reactor to said gas outlet of said contactor for co-current flow through said reactor with respect to the pulp, and wherein an elbow connection connects said pulp inlet of said reactor to said pulp outlet of said contactor, means for flowing the pulp downward through said reactor at a first velocity, means for flowing the gas downward through the reactor at a second velocity, the second velocity being substantially greater than said first velocity; and wherein said contactor further includes means for shredding the high consistency pulp supplied to said pulp inlet of said contactor and means for fluffing the shredded pulp.

2. The system as recited in claim 1, wherein:

said substantially vertical pin/foil contactor further includes a generally cylindrical housing communicating with said gas inlet and outlet, and said pulp inlet and outlet of said contactor;

said means for shredding the pulp comprises a shaft rotatably mounted within said housing, a drum attached to said shaft for rotation therewith, and helically disposed screw flight attached to said drum and aligned with said pulp inlet of said contactor, wherein said screw flight includes a plurality of teeth-like surfaces disposed along an outer periphery of said screw flight.

3. The system as recited in claim 2, wherein:

said means for fluffing the shredded pulp comprises a plurality of pins attached to said drum and extending radially outwardly from said drum.

4. The system as recited in claim 2, wherein:

said means for fluffing comprises a means for creating a rotating annulus of fluidized particles of the shredded pulp and for combing the rotating annulus of fluidized pulp particles;

said rotating annulus of fluidized pulp particles is rotatable about an axially extending centerline axis of said pin/foil contactor.

5. The system as recited in claim 4, wherein:

said axially extending centerline axis is substantially vertical.

6. The system as recited in claim 4, wherein:

said housing of said pin/foil contactor includes an upper portion and a lower portion;

said creating and combing means comprises said drum, an inner wall of said lower portion of said housing, and a plurality of pins attached to said drum and extending radially outwardly from said drum.

7. The system as recited in claim 2, wherein:

the upper end of said contactor comprises a gas separation chamber.

* * * * *